US006554964B2

(12) United States Patent
Brox

(10) Patent No.: US 6,554,964 B2
(45) Date of Patent: Apr. 29, 2003

(54) SHOE PRESS AND SHOE SUPPORT DEVICE THEREFOR

(75) Inventor: Erik Brox, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 10/241,917

(22) Filed: Sep. 12, 2002

(65) Prior Publication Data

US 2003/0010464 A1 Jan. 16, 2003

Related U.S. Application Data

(63) Continuation of application No. PCT/SE01/00533, filed on Mar. 15, 2001.
(60) Provisional application No. 60/200,203, filed on Apr. 28, 2000.

(51) Int. Cl.[7] ..... D21F 3/02

(52) U.S. Cl. ..... 162/358.3; 162/361; 100/153

(58) Field of Search ..... 162/358.3, 361, 162/305; 100/153, 154

(56) References Cited

U.S. PATENT DOCUMENTS 4,917,768 A * 4/1990 Ilmarinen ..... 162/358.3
5,650,047 A 7/1997 Meschenmoser

FOREIGN PATENT DOCUMENTS

EP 0 345 501 B1 12/1989

* cited by examiner

*Primary Examiner*—Karen M. Hastings
(74) *Attorney, Agent, or Firm*—Alston & Bird LLP

(57) ABSTRACT

A shoe press comprises a shoe support device mounted downstream of the press shoe of the shoe press to carry forces acting on the press shoe and having a first support element that has a support surface facing the press shoe and is fixedly connected to a stationary stand of the shoe press, and a second support element in the form of at least one rolling body arranged in a space between the support surface of the first support element and an opposite support surface of the press shoe to be in contact with the two support surfaces during operation. The rolling body is arranged to roll along the two support surfaces when the press shoe is moved relative to a second support element in the shoe press, while rotating about an axis of rotation that moves in relation to and in the same direction as the press shoe.

31 Claims, 9 Drawing Sheets

SHOE PRESS AND SHOE SUPPORT DEVICE THEREFOR

CROSS-REFERENCE TO RELATED APPLICATION

This application is a continuation of International PCT Application No. PCT/SE01/00533 filed Mar. 15, 2001, incorporated herein by reference, which application designated inter alia the United States and was published under PCT Article 21(2) in English. This application also claims the benefit of U.S. Provisional Patent Application No. 60/200,203 filed Apr. 28, 2000, which is incorporated herein by reference.

FIELD OF THE INVENTION

The invention relates to shoe presses for pressing a web of paper or cardboard during its manufacture or treatment. The invention relates more particularly to a shoe press having a shoe support device for reacting forces that act on the press shoe in the machine and/or the cross-machine direction, and to such a shoe support device, wherein the shoe support device includes a first support element affixed to a support stand of the shoe press and having a support surface facing the press shoe, and a second support element in the form of at least one rolling body arranged in a space defined between the support surface of the first support element and an opposite support surface of the press shoe so as to be in contact with the two support surfaces during operation.

BACKGROUND OF THE INVENTION

A shoe press and shoe support device of the kind described above is known through EP-0 345 501, see FIG. 1. According to this document, the rolling bodies are rotatably journaled on the downstream side of the press shoe and abut a support surface on the fixed support element and an opposite support surface on the press shoe. As the rolling bodies are rotatably journaled on the side of the press shoe, the axis of rotation of each rolling body is always in a fixed position in relation to the press shoe, irrespective of the movement up and down of the press shoe. However, the known construction causes the rolling bodies to become unrotatably jammed between the two support surfaces, especially with the great forces that arise during operation at increased machine speeds. Accordingly, the jamming causes the rolling bodies to slide along the support surface of the fixed support element with consequent friction therebetween.

U.S. Pat. No. 5,650,047 describes a solution to the problem with friction between the press shoe and the fixed support element by arranging spacers in either the fixed support element or the press shoe, which spacers are in the shape of rods, each of which has one end supported on a support surface of the press shoe (alternatively, in the fixed support element) and its other end resting on the bottom of a borehole in the fixed support element (alternatively, in the press shoe), the boreholes having a diameter greater than the rods so that these can follow the radial movements of the press shoe without the support position of the ends of the rods being changed. The present invention solves the friction problem in a way that essentially differs from the known solution in accordance with U.S. Pat. No. 5,650,047.

SUMMARY OF THE INVENTION

The object of the present invention is to provide a shoe press, as well as a shoe support device, that utilizes rolling bodies, wherein the tractive forces of the press shoe are transmitted to the fixed support element via the rolling bodies without friction arising between load-transmitting surfaces.

In accordance with the invention, the shoe press, as well as the shoe support device, is characterized in that, when the press shoe is moved relative to the second press element, the at least one rolling body is arranged to roll along the two support surfaces while rotating about an axis of rotation that moves relative to and in the same direction as the press shoe.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
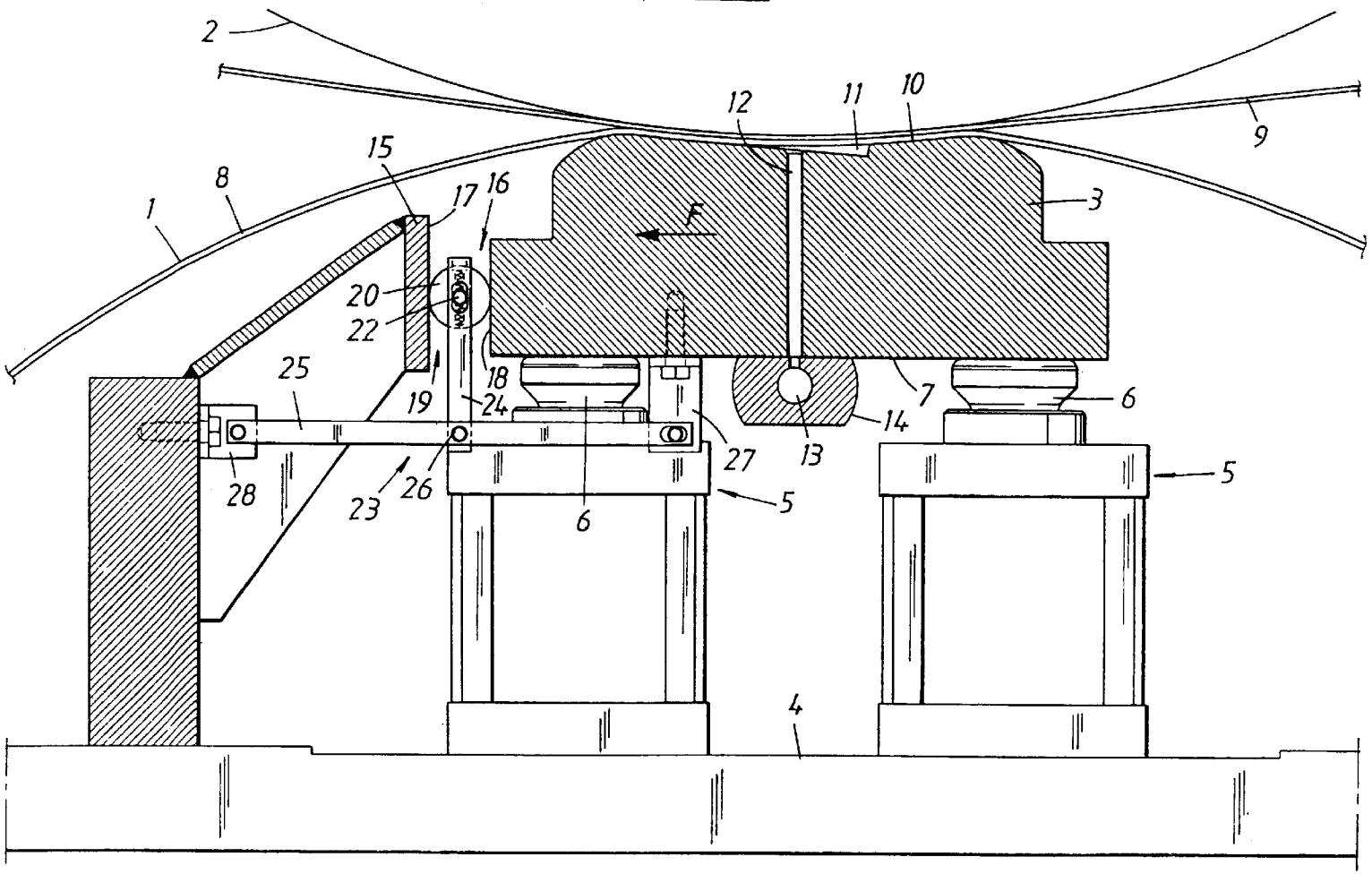
FIG. 1 shows schematically in cross section parts of a shoe press with a shoe support device in accordance with a first embodiment of the invention.

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1, 2, 4, 5 and 7 show schematically parts of shoe presses arranged in a paper or cardboard machine to press water out of a formed wet fiber web. Each shoe press comprises a first press element 1 and a second press element 2, which press elements cooperate with each other to form an extended press nip. In the embodiments shown, the second press element 2 consists of a counter roll. The first press element 1, which can consist of a shoe press roll, comprises a press shoe 3 and an inner stand, comprising a stationary, axial beam 4, extending between the end walls (not shown) of the shoe press roll and supporting a power transmission member 5 for moving and pressing the press shoe 3 against the counter roll 2. In the embodiment shown of the shoe press roll 1, the power transmission member 5 consists of two parallel rows of jacks, the vertical piston rods 6 of which have their ends freely contacting the horizontal underside 7 of the press shoe 3, which underside faces away from the press nip, so that the press shoe 3 is free to move in its plane, i.e. horizontally, within certain limitations. The press shoe 3 has no definite, fixed rotary axis. The press shoe 3 can be made in one piece, as shown in the drawings, or composed of an upper press part and a lower support part, in which case the separation can be performed at the shown angular corners with depressions in the support part for the bottom part of the press part. In an alternative embodiment (not shown), the jacks are arranged one after the other in only one row. It is, of course, possible to use other types of power transmission members, for instance one or several pairs of bellows, operating with a suitable pressure medium to influence the press shoe, directly or indirectly, to move as desired.

Each shoe press roll 1 comprises a movable belt 8 that is impermeable to liquid and which, at the entrance to the extended press nip, encounters a press felt 9 supporting the wet fiber web (not shown). In accordance with an alternative embodiment (not shown), the shoe press lacks such a press felt; whilst in another alternative embodiment (not shown), the shoe press is provided with two press felts for enclosing the web between them. The press shoe 3 has a sliding surface 10, on which the belt 8 slides, and is provided with a plurality of hydrostatic press pockets 11 that are supplied with pressurized liquid from a supply via a channel system comprising a central vertical passage 12 in the press shoe 3 and an axial passage 13 in a distributing element 14 on the underside 7 of the press shoe 3, which underside faces away from the slide surface 10.

During operation, great forces are transmitted to the press shoe 3 from the belt 8. To relieve the press shoe 3 in its set operating position, the shoe press roll 1 is provided with a shoe support device, which is mounted in connection with the downstream side of the press shoe 3 and which comprises a first support element 15 and a second support element 16, which support elements can be described as outer and inner support elements, respectively, relative to the press shoe 3. The outer support element 15 is fixedly mounted on the stationary beam 4 and has a vertical support surface 17, facing a vertical, downstream support surface 18 of the press shoe 3. The outer support element 15 is arranged at a predetermined distance from the press shoe 3, as measured in respect, of a normal operating position for the press shoe 3, so that an interspace 19 is formed between the two support surfaces 17, 18. The inner support element 16 has the shape of one or several rolling bodies 20, located in said interspace 19 to cooperate with the two support surfaces 17, 18 during operation, so that the horizontal forces F acting on the press shoe 3 are transmitted to the outer support element 15 via the inner support element 16. The rolling bodies 20 preferably consist of solid rollers with a circular cross section, but can also consist of spherical balls. For a machine with relatively narrow width, it is possible to use a single rolling body in the shape of an elongate solid rod that has a circular cross section and which thus has a rotationally symmetrical envelope surface. For the same machine, and especially for wider machines, it is possible to use a plurality of relatively short solid rollers that are arranged co-axially one after the other, as shown in the drawings, and which are equiform, at least with respect to their cross section, and which thus have like rotationally symmetrical envelope surfaces and co-axial axes of rotation.

Figure 3:
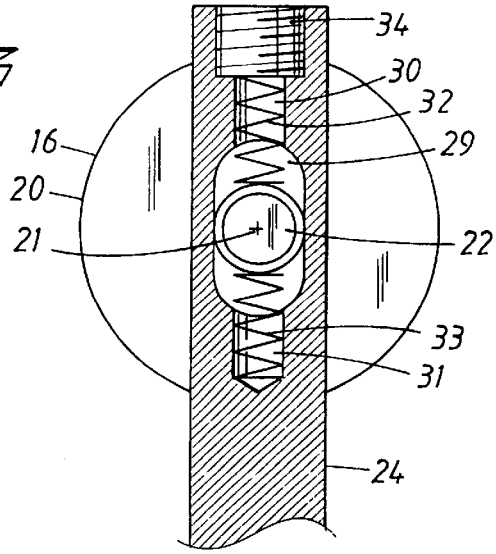
FIG. 3 is an enlargement of a detail of the shoe support device in accordance with FIG. 1.

In accordance with the present invention, the rolling bodies 20 are arranged to rotate about an axis of rotation 21 (see FIG. 3) to roll along both support surfaces 17, 18, when the press shoe 3 is moved up or down in the vertical direction, as seen in FIG. 1, for instance. The axis of rotation 21, which thus is horizontal and parallel to the upstream support surface 18 of the press shoe 3, will thereby be moved in relation to and in the same direction as the press shoe 3. As the shoe support device comprises support and journaling members for supporting the rolling bodies 20, the fact must be taken into consideration that the axis of rotation 21 of a rolling body 20 moves half the distance that the press shoe 3 moves simultaneously.

Figure 2:
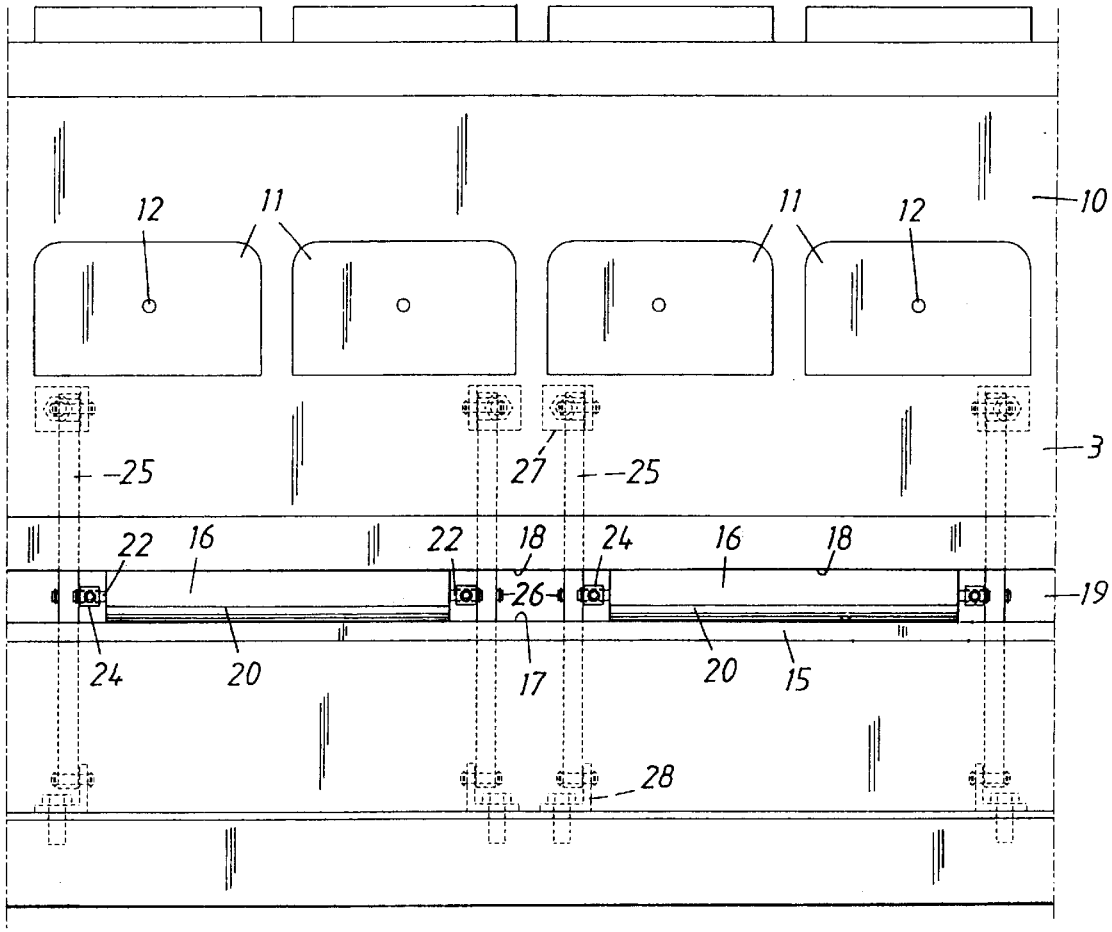
FIG. 2 is a top view of parts of the shoe press roll in the shoe press shown in FIG. 1.

The shoe press roll 1 in accordance with FIGS. 1 and 2 has a shoe support device in accordance with a first embodiment of the invention. The shoe support device shown therein has a plurality of rolling bodies 20 and support and journaling members for the same. The rolling bodies 20 consist of rollers that are spaced a short distance one after the other, as illustrated in FIG. 2. Each roller 20 has co-axial journaling pins 22 at its ends, which journaling pins 22 define the axis of rotation 21 of the roller 20. It is understood that the axes of rotation 21 of the rollers 20 are co-axial with each other. The support and journaling members comprise a plurality of link-arm systems 23 for supporting the rollers 20 via their journaling pins 22. Each link-arm system 23 comprises a straight, vertical link arm 24 and a straight, horizontal link arm 25. The vertical link arm 24 supports the roller 20 at one of its journaling pins 22 in a rotatable relationship and has its lower end pivotally connected to a pivot point 26 at the midpoint of the horizontal link arm 25. One end of the horizontal link arm 25 is pivotally mounted to a first mounting piece 27 that is rigidly mounted to the press shoe 3 on its underside 7 and at a distance from the downstream support surface 18 of the press shoe 3, whilst the other end of the horizontal link arm is pivotally mounted to a second mounting piece 28 rigidly mounted to the outer support element 15. As is evident from FIG. 3, the vertical link arm 24 is provided with an oval hole 29 for receiving the journaling pin 22. The link arm 24 is on both sides of the oval hole 29 provided with vertical, concentric boreholes 30, 31 for springs 32, 33 placed therein and acting against the journaling pin 22 so that the same becomes spring-loaded and can be influenced to parallel motion in the oval hole 29. A plug 34 in the upper borehole 30 ensures that the upper spring 33 is retained in position. A rotary motion of the press shoe 3 about a horizontal rotary axis that is perpendicular to the machine direction causes a movement of the upstream and downstream end parts of the press shoe 3, which can result in detrimental strains in the stiff link arms 24, 25 and their pivot points 26 with each other and with the journaling pins 22 of the rollers 20. The described spring arrangement for the journaling pins 22 absorbs such rotary movements so that the link-arm system 23 and the journaling pins 22 are not subjected to the detrimental strains. Such rotary motions can arise, for instance, when the fiber web contains fiber knots that during their passage through the extended press nip first force the upstream part of the press shoe 3 and then its downstream part to move in the direction away from the counter roll 2.

Figure 4:
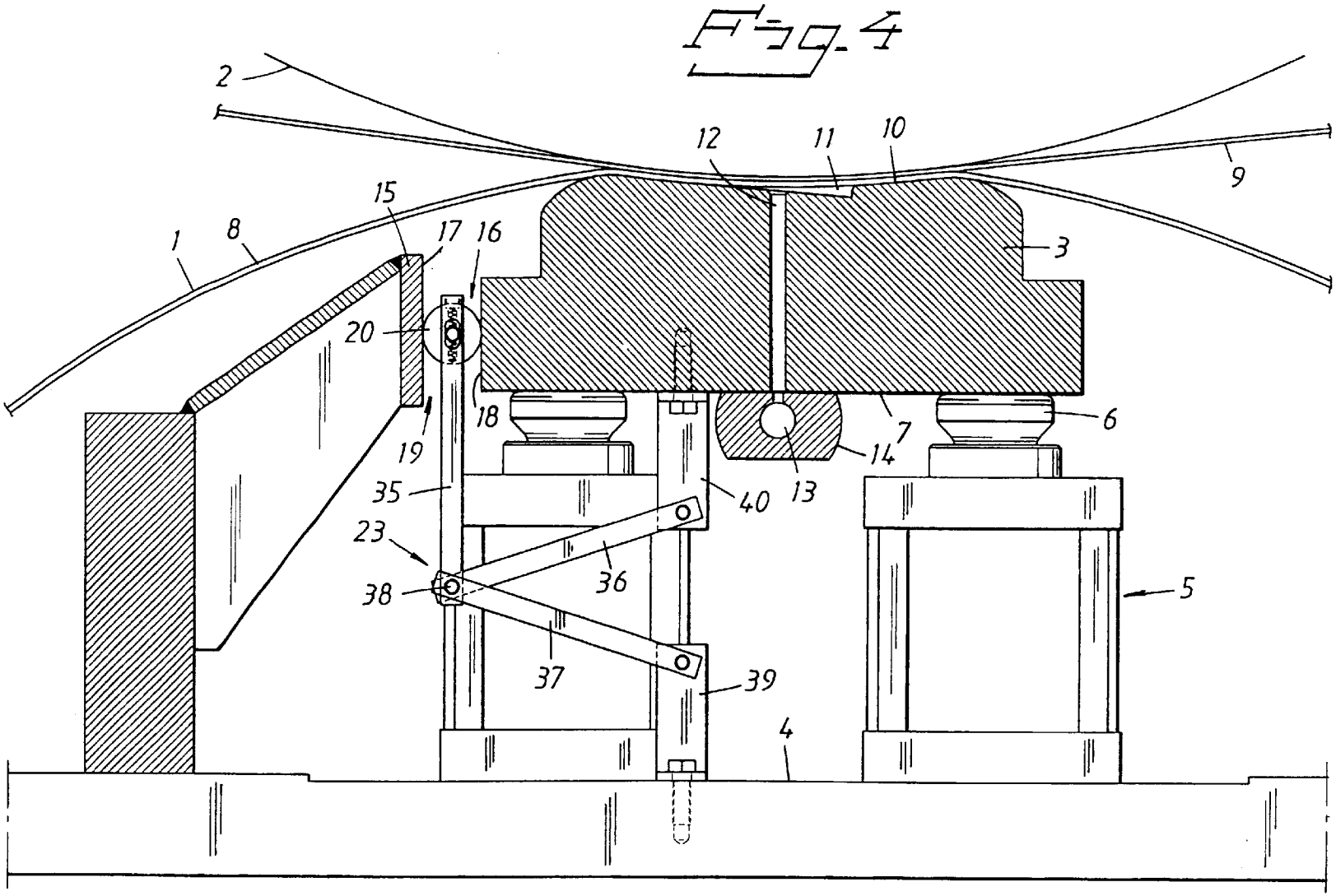
FIG. 4 shows schematically in cross section parts of a shoe press with a shoe support device in accordance with a second embodiment of the invention.

The shoe press roll in accordance with FIG. 4 has a shoe support device in accordance with a second embodiment of the invention. The shoe support device shown is similar to the one in accordance with FIG. 1, but is provided with a modified link-arm system 23 for each journaling pin 22. The link-arm system 23 has a vertical link arm 35 and two lower link arms 36, 37 of equal length and connected to the vertical link arm in a common pivot point 38 at the lower end of the vertical link arm 35. The two lower link arms 36, 37 extend in the direction from the outer support element 15 and away from each other to form the same acute angle with the horizontal plane. The link arm 37 directed obliquely downwards is with its lower end pivotally mounted on a lower mounting piece 39, which is rigidly mounted on the beam 4, whilst the link arm 36 directed obliquely upwards is with its upper end pivotally mounted on an upper mounting piece 40, which is rigidly mounted on the underside 7 of the shoe press 3 in alignment with the lower mounting piece 39 and at a distance from the vertical support surface 18 of the press shoe 3.

Figure 5:
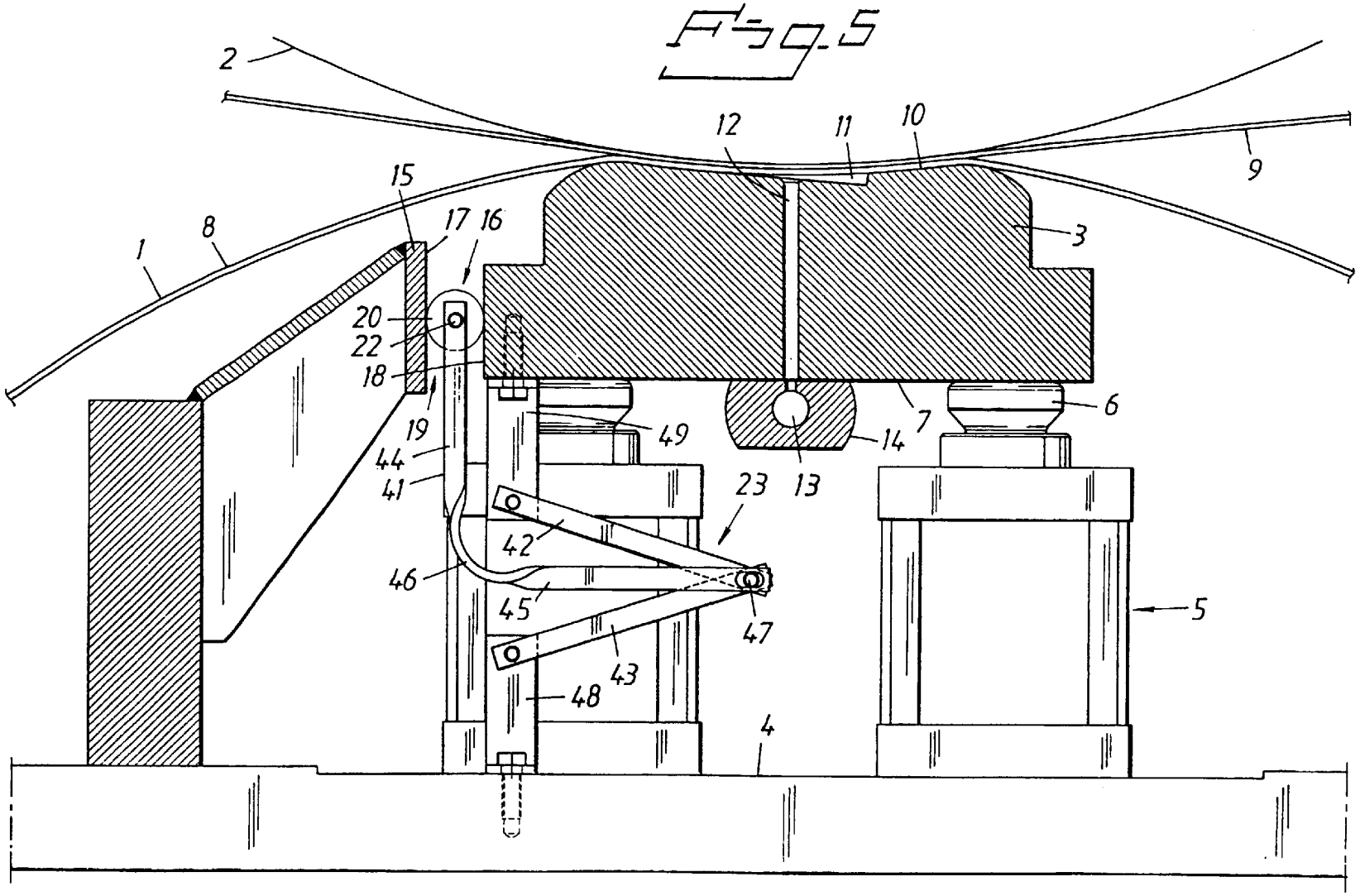
FIG. 5 shows schematically in cross section parts of a shoe press with a shoe support device in accordance with a third embodiment of the invention.
Figure 6:
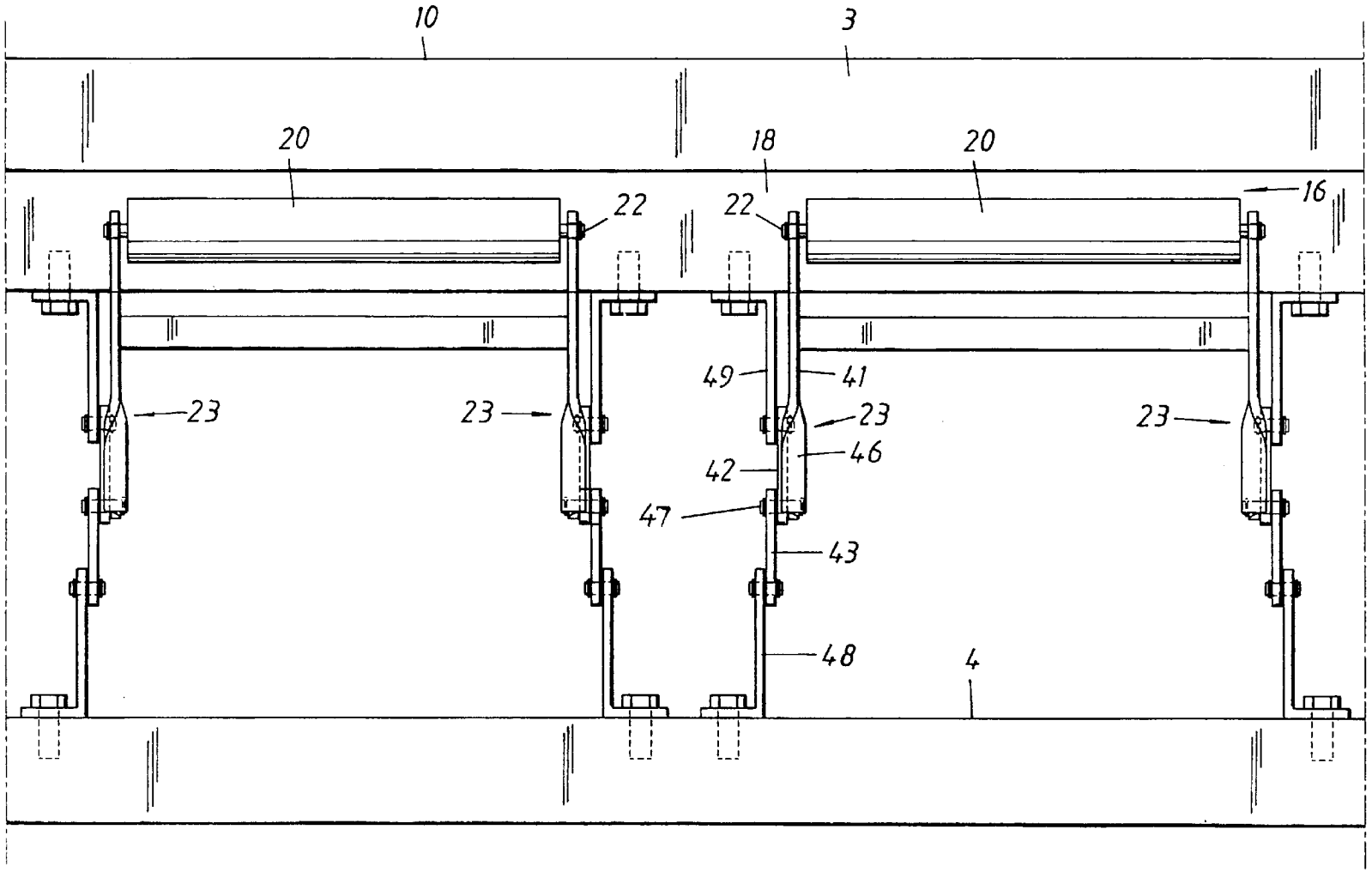
FIG. 6 is a side view, seen against the machine direction, of parts of the shoe press in accordance with FIG. 5.

The shoe press roll in accordance with FIGS. 5 and 6 has a shoe support device in accordance with a third embodiment of the invention. The shoe support device shown is similar to the one in FIG. 1, but is provided with a modified link-arm system 23 for each journaling pin 22. The link-arm system 23 has an angled link arm 41 and two lower, straight link arms 42, 43 of equal length. The angled link arm has a vertical part 44, a horizontal part 45 and a flexible intermediate part 46. The three arms 41, 42, 43 are journaled in a common pivot point 47 located at the lower end of the angled link arm 41, the hole in the part 45 for the pivot point 47 having an oval shape. The two straight link arms 42, 43 extend one on each side of the lower part 45 of the angled link arm 41 and form acute equiangular angles with the same. The link arm 43 directed obliquely downwards has its lower end pivotally mounted on a lower mounting piece 48, which is rigidly mounted on the beam 4, whilst the link arm 42 directed obliquely upwards has its upper end pivotally mounted on an upper mounting piece 49 that is rigidly mounted on the underside 7 of the shoe press 3 in alignment with the lower mounting piece 48 and immediately adjacent to the support surface 18 of the press shoe 3. The flexible intermediate part 46 of the angled link arm 41 enables the angled arm 41 to deflect in the event of an external undesired stress in the vertical part 44 of the angled link arm 41 and resiliently resume its initial position when said stress ceases. One such external undesired stress originates in a rotary motion in the press shoe 3, as described in connection with the spring arrangement for the embodiments in accordance with FIGS. 1–4. The flexible, resilient intermediate part 46 thus has the same function as said spring arrangement. The described link-arm system 23 results in a gearing-down of motion so that the vertical part 44 of the angled link arm 41 corresponds to the movement of the axis of rotation of the roller, i.e. half the distance by which the press shoe 3 is moved up or down. It is understood that the axis of rotation 21 moves in the same direction as the press shoe 3.

Figure 7:
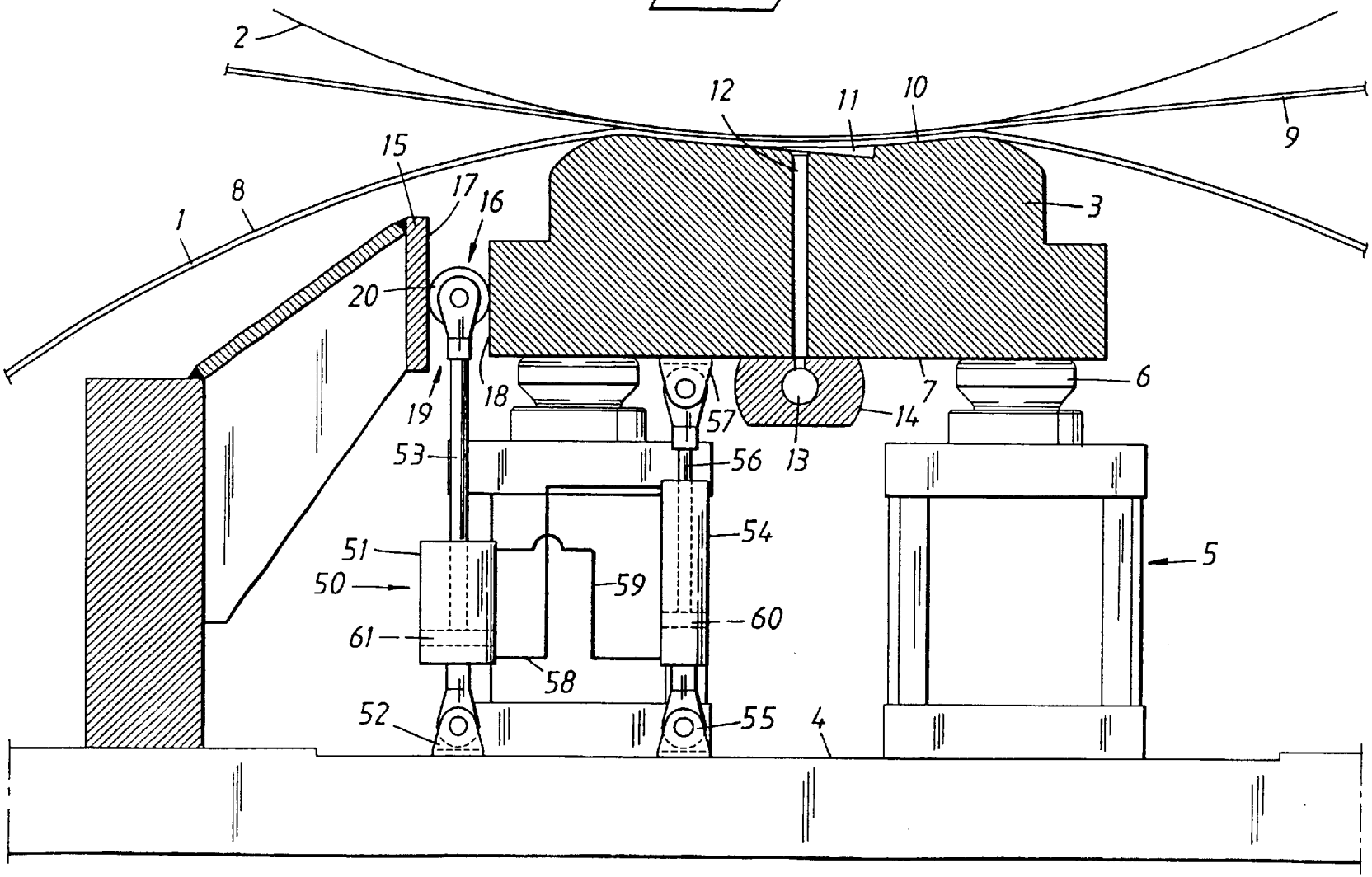
FIG. 7 shows schematically in cross section parts of a shoe press with a shoe press device in accordance with a fourth embodiment of the invention.

The shoe press roll in accordance with FIG. 7 has a shoe support device in accordance with a fourth embodiment of the invention. In this embodiment, the support and journaling members comprise power-cylinder systems 50, each comprising a first power cylinder 51, which with its rear piston-cylinder end is pivotally journaled on a fixed mounting lug 52 on the beam 4 and with its piston rod 53 extends up to the interspace 19 for the rollers 20, which in this case are rotatably supported by the upper end of the piston rod 53. Further, each power-cylinder system 50 has a second power cylinder 54, which with its rear piston-cylinder end is pivotally journaled on a fixed mounting lug 55 on the beam 4 and with its piston rod 56 extends up to the press shoe 3, which, on its underside 7, is provided with a fixed mounting lug 57 to pivotally journal the piston rod 56 at its upper end. The two power cylinders 51, 54 communicate with each other by way of pipes 58, 59 so that a downward movement of the piston 60 of the second power cylinder 54 results in a downward movement of the piston 61 of the first power cylinder 51 and vice versa with consequent movement of the roller 20. The piston 61 of the first power cylinder 51 has pressing areas twice as large as the piston 60 of the second power cylinder 54 so as thereby to obtain a gear ratio of 2:1 between the distances of travel of the press shoe 3 and the axis of rotation 21 of the roller 20. In the embodiment shown, the second power cylinder 54 is mounted with its piston rod 56 on the press shoe 3 at a location situated a distance from the support wall 18 of the press shoe 3. Alternatively, this mounting location is situated as close to said support surface 18 as possible. The power cylinders 51, 54, which thus have a closed circuit loop for the pressure medium, can consist of hydraulic or pneumatic cylinders. A system with a pressure medium results in the piston 61 in the first power cylinder 51 not being butt but being resilient to some extent to assume the same function as the previous arrangement with springs 32, 33, for instance.

Figure 8:
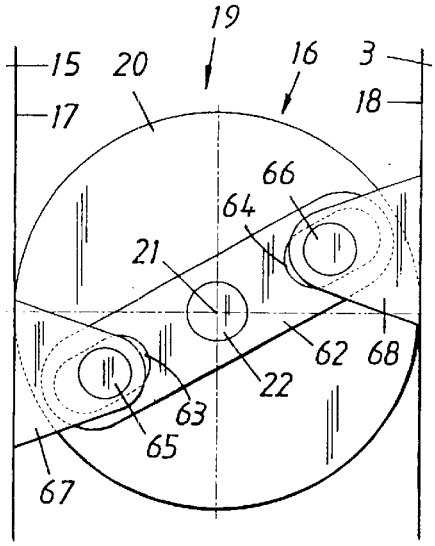
FIG. 8 shows schematically a shoe support device in accordance with a fifth embodiment of the invention.
Figure 11:
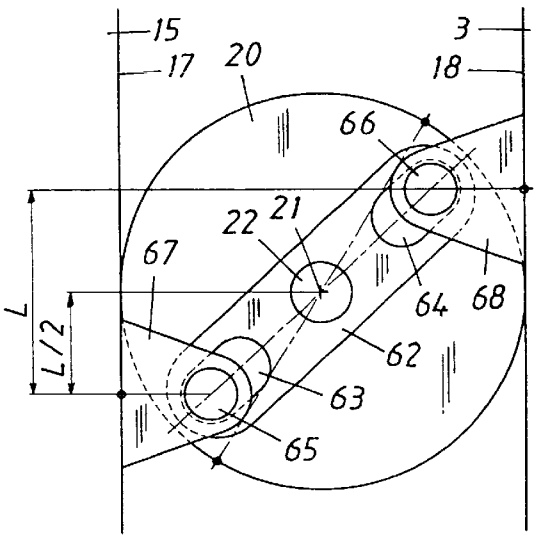
FIG. 11 shows the shoe support device in accordance with FIG. 8 in a third operating position.
Figure 10:
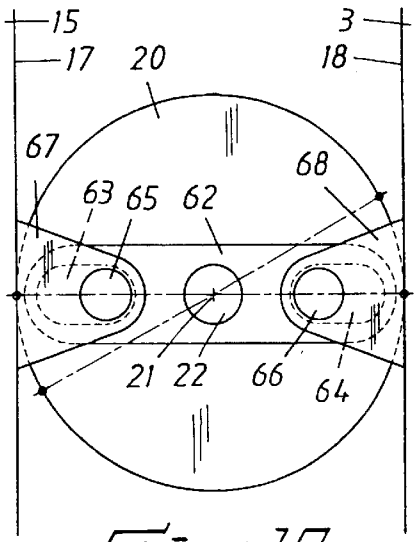
FIG. 10 shows the shoe support device in accordance with FIG. 8 in a second operating position.
Figure 9:
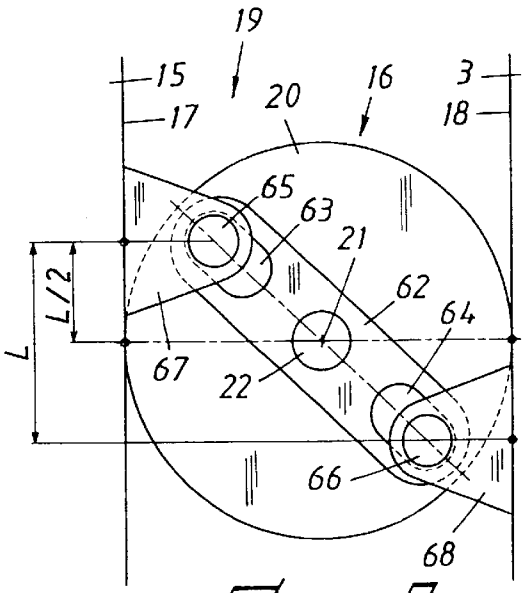
FIG. 9 shows the shoe support device in accordance with FIG. 8 in a first operating position.

FIG. 8 shows a shoe support device in accordance with a fifth embodiment of the invention. The shoe support device is similar to the one in FIG. 1, but is provided with a modified link-arm system 23 for each journaling pin 22. The link-arm system has a single link arm 62, having a straight shape of a length somewhat shorter than the diameter of the roller 20 so as not to contact the support walls 17, 18. The link arm 62 is journaled at its center to the journaling pin 22 and has oval holes 63, 64 at both its end parts, each for receiving a guide pin 65, 66 respectively supported by a first mounting lug 67 that is rigidly arranged on the vertical support wall 17 of the outer support element 15 and a second mounting lug 68 that is rigidly arranged on the vertical support wall 18 of the press shoe 3. The length of the oval holes 63, 64, that is the dimension in the longitudinal direction of the link arm 62, is adapted to the lower and upper end positions of the roller 20, as well as its intermediate position when the link arm 62 is directed horizontally. FIGS. 9–11 illustrate these three different positions and the correlation between the distance of travel of the press shoe 3 and the distance of travel of the axis of rotation 21 of the roller 20, i.e. from one end position to the intermediate position the press shoe 3 travels the distance L, whilst the axis of rotation 21 travels the distance L/2. The same relationship of ½ also applies to all intermediate positions measured from a point where the press shoe 3 starts to move.

Figure 12:
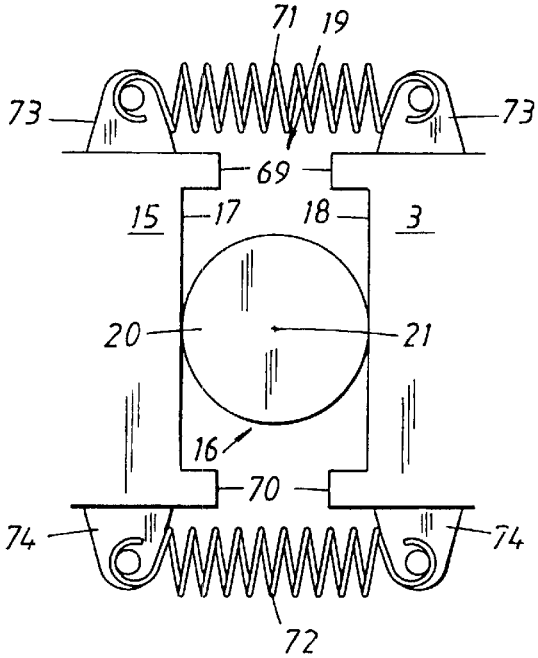
FIG. 12 shows schematically a shoe support device in accordance with a sixth embodiment of the invention.

FIG. 12 shows schematically a shoe support device in accordance with a sixth embodiment of the invention. The inner support element 16 consists of a single rolling body 20 in the shape of an elongate rod-shaped roller, extending along the entire press shoe 3. Alternatively, the inner support element 16 is fashioned as several short rollers 20 co-axially arranged one after the other. When the press shoe 3 moves in a vertical direction up or down, the roller 20 will roll along the two parallel support surfaces 17, 18, while rotating about its axis of rotation 21, which thus moves in the same direction as the press shoe 3 a distance equivalent to half the distance moved by the press shoe 3. To prevent the roller 20 from rolling out from the support surfaces 17, 18, the fixed support element 15 and the press shoe 3 are provided with upper and lower protrusions 69, 70, facing each other. To prevent the roller from falling out of the interspace 19, upper and lower springs 71, 72 are suspended between attachment lugs 73, 74 on the fixed support element 15 and the press shoe 3, which springs 71, 72 ensure that the roller 20 is retained in its initial position by the resilient abutment of the press shoe 3 against the roller 20.

Figure 13:
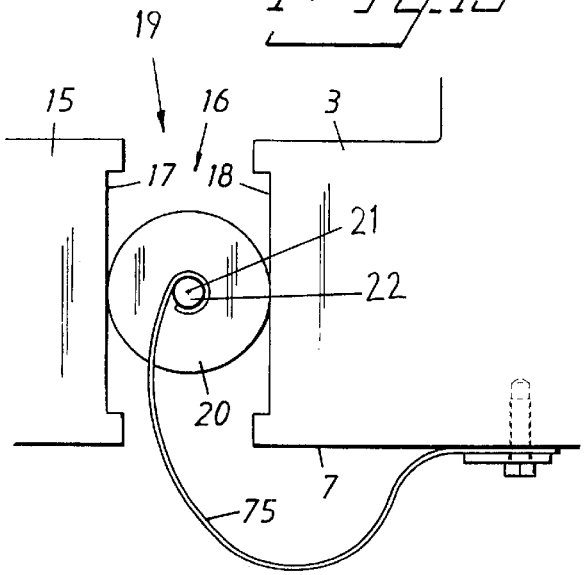
FIG. 13 shows schematically a shoe support device in accordance with a seventh embodiment of the invention.

FIG. 13 shows schematically a shoe support device in accordance with a seventh embodiment of the invention that is similar to the one in FIG. 12, except that the springs are replaced by leaf springs 75 curved in the shape of an arc and supporting the rollers 20 via their journaling pins 22 in a rotatable relationship. Each leaf spring 75 is rigidly anchored to the underside 7 of the press shoe 3. The leaf springs, together with the journaling pins 22, thus act as support and journaling members for the rollers 20.

Figure 14:
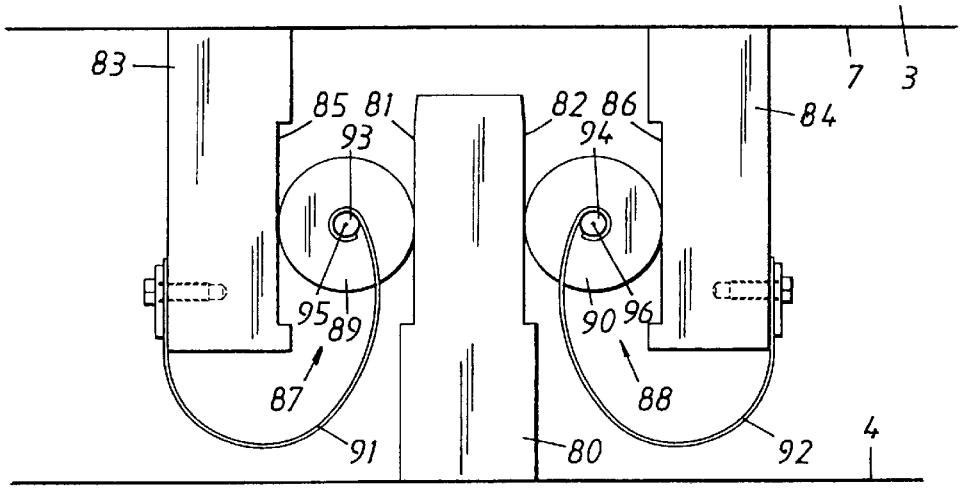
FIG. 14 shows schematically a shoe press with a second shoe support device for retaining the press shoe in its operating position across the machine direction.
Figure 15:
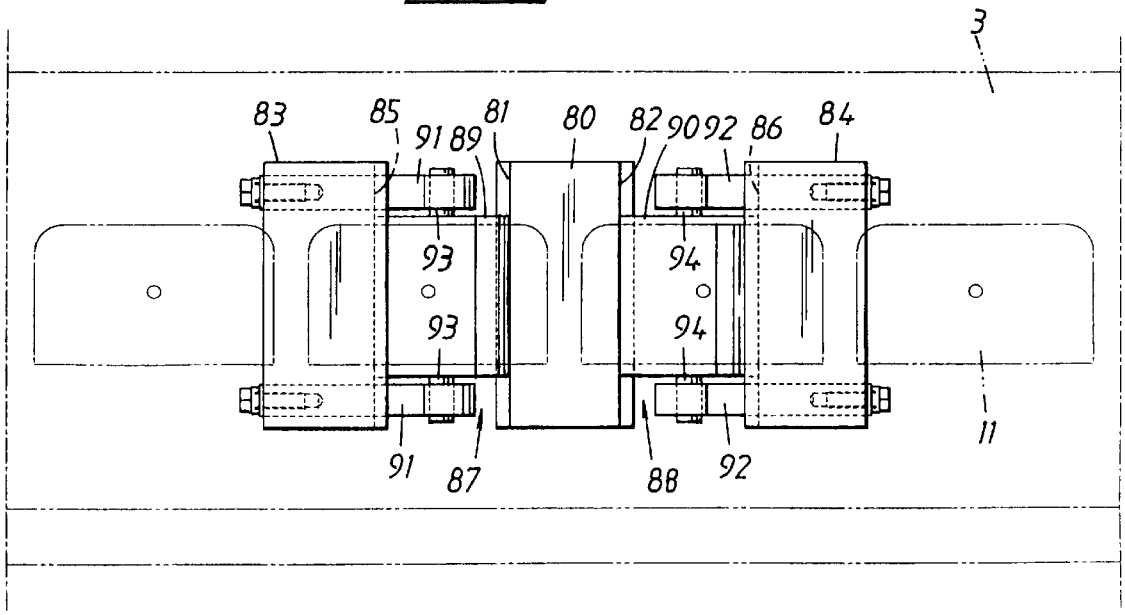
FIG. 15 is a top view of a shoe support device in accordance with FIG. 14.

The embodiments shown in the drawings and described above with respect to the suspension of the rolling bodies can also be applied to retain the press shoe in the correct operating position across the machine direction, i.e. so that the press shoe is prevented from being displaced in its longitudinal direction. Such an embodiment is shown in FIGS. 14 and 15 and can be utilized in combination with one of the shoe support devices described above, being intended to carry loads in the machine direction, or be utilized on its own without such a shoe support device or with a different type of shoe support device. The shoe support device shown in FIGS. 14 and 15 for absorbing lateral forces acting on the press shoe across the machine direction during operation comprises a vertical, block-like support element 80, rigidly connected to the beam 4 at the center, that is the middle, of the press shoe 3, as seen in its longitudinal direction, which support element 80 has two vertical, parallel support surfaces 81, 82, facing away from each other and extending in the machine direction. An example of such lateral forces is those that arise when the press shoe expands due to absorption of heat. Further, this second shoe support device comprises a vertical, ball-like outer support element 83, 84 on each side of the support element 80. The two support elements 83, 84 are rigidly mounted on the underside 7 of the press shoe 3 and extend downwards from the press shoe 3 to enclose the medial support element 80 between them, but at a pre-determined distance from the same. The two outer support elements 83, 84 have inner, vertical support surfaces 85, 86 that face the respective support surfaces 81, 82 of the medial support element 80 and are parallel to these support surfaces 81, 82. The support surfaces 81, 85; 82, 86, which face each other, form between them first and second interspaces 87, 88 for receiving a rolling body in the shape of a roller 89, 90 in each interspace 87, 88. The rollers 89, 90 are supported and rotatably journaled by means of support and journaling members, which in the embodiment shown comprise two leaf springs 91, 92 for each roller 89, 90. Each leaf spring 91, 92 has its one end journaled to the journaling pin 93, 94 of the roller 89, 90 in a rotatable relationship and has its other end rigidly mounted to the adjacently located pendent outer support element 83, 84. When the press shoe 3 is moved relative to the counter roll 2, the rollers 89, 90 will roll along the four support surfaces 81, 85 and 82, 86 and their axes of rotation 95, 96 will be moved in the same direction as the press shoe 3, but by a distance that is half the distance covered by the press shoe 3. Any of the herein previously described support and journaling members can be used instead of the leaf springs 91, 92, if so desired. It is understood that this second shoe support device provides a butt joint between the stand 4 and the press shoe 3, as seen across the machine direction, while simultaneously allowing the press shoe to move relative to the counter roll 2 and the stand 4 without other friction than the rolling friction of the rollers 89, 90.

The shoe press has been described in the context of a paper or cardboard machine, but can obviously also be used in a machine for treating a paper web, a calender, for instance.

For the sake of simplicity, the invention has been described by using expressions such as "vertical", "horizontal", "underside" and the like, which refer to a shoe press mounted in such a way that these expressions apply to such an assembly where a line between the center of the counter roll 2 and the center of the shoe press roll 1 is vertical or substantially vertical. Thus, the invention is not limited to such an assembly and any other assembly desired in practice is possible with said line in a slanting relationship to the horizontal plane.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A shoe press for treating a traveling web of paper or board, comprising:

first and second press elements arranged to form an extended nip therebetween in which the web is pressed, the first press element comprising a press shoe movable along a pressing direction toward and away from the second press element, an impermeable belt arranged to travel in an endless loop and make sliding contact with a pressing surface of the press shoe, and a power transmission member structured and arranged to urge the press shoe in the pressing direction toward the second press element to press the web in the nip; and a shoe support device comprising a first support element arranged such that a support surface of the first support element faces an opposing support surface of the press shoe with a space being defined between said support surfaces, the shoe support device further comprising a second support element in the form of at least one rolling body arranged in the space between said support surfaces and in rolling contact with said support surfaces such that upon movement of the press shoe relative to the second press element the at least one rolling body rolls along said support surfaces and rotates about an axis of rotation that moves relative to and in the same direction as the press shoe.

2. The shoe press of claim 1, wherein said support surfaces of the first support element and press shoe extend parallel to said pressing direction along which the press shoe is moved to press the web.

3. The shoe press of claim 1, wherein the power transmission member is supported on a stationary support and the first support element is fixed relative to said stationary support.

4. The shoe press of claim 1, wherein the shoe support device further comprises support and journaling members for said at least one rolling body, the support and journaling members comprising at least one journaling pin for each rolling body for defining said axis of rotation.

5. The shoe press of claim 4, wherein the support and journaling members further comprise a link-arm system for supporting each rolling body via said at least one journaling pin.

6. The shoe press of claim 5, wherein the link-arm system is pivotally connected to a fixed member of the first press element and is pivotally connected to the press shoe.

7. The shoe press of claim 5, wherein the link-arm system comprises a link arm that supports the journaling pin via a resilient arrangement in said link arm to absorb stresses caused by rotary movements of the press shoe about a rotary axis that is perpendicular to a machine direction along which the web travels.

8. The shoe press of claim 4, wherein the support and journaling members comprise a power cylinder system for supporting each rolling body via said at least one journaling pin.

9. The shoe press of claim 1, wherein the support surfaces of the first support element and press shoe extend in a machine direction such that the shoe support device reacts lateral forces acting on the press shoe in a cross-machine direction during operation.

10. The shoe press of claim 1, wherein the support surfaces of the first support element and press shoe extend in a cross-machine direction such that the shoe support device reacts longitudinal forces acting on the press shoe in a machine direction during operation.

11. The shoe press of claim 10, further comprising a second shoe support device arranged to react lateral forces acting on the press shoe in a cross-machine direction during operation, the second shoe support device comprising at least a pair of support surfaces one of which is fixed relative to the press shoe and the other of which is stationary and which support surfaces extend in a machine direction and define a space therebetween, and at least one rolling body arranged in said space so as to roll along said support surfaces about a rotation axis that moves relative to and in the same direction as the press shoe.

12. The shoe press of claim 11, wherein the second shoe support device comprises support and journaling members for said at least one rolling body, the support and journaling members comprising at least one journaling pin for each rolling body for defining said axis of rotation.

13. The shoe press of claim 12, wherein the support and journaling members for the second shoe support device comprise a link-arm system for supporting each rolling body via said at least one journaling pin.

14. The shoe press of claim 13, wherein the link-arm system for the second shoe support device is pivotally connected to a fixed member of the first press element and is pivotally connected to the press shoe.

15. The shoe press of claim 12, wherein the support and journaling members for the second shoe support device comprise a power cylinder system for supporting each rolling body via said at least one journaling pin.

16. A shoe support device for a shoe press of a machine for manufacturing or treating a paper or cardboard web, wherein the shoe press includes first and second press elements arranged to form an extended nip therebetween in which the web is pressed, the first press element comprising a press shoe movable along a pressing direction toward and away from the second press element, an impermeable belt arranged to travel in an endless loop and make sliding contact with a pressing surface of the press shoe, and a power transmission member structured and arranged to urge the press shoe in the pressing direction toward the second press element to press the web in the nip, the shoe support device comprising:

a first support element arranged such that a support surface of the first support element faces an opposing support surface of the press shoe with a space being defined between said support surfaces, the shoe support device further comprising a second support element in the form of at least one rolling body arranged in the space between said support surfaces and in rolling contact with said support surfaces such that upon movement of the press shoe relative to the second press element the at least one rolling body rolls along said support surfaces and rotates about an axis of rotation that moves relative to and in the same direction as the press shoe.

17. The shoe support device of claim 16, further comprising support and journaling members for said at least one rolling body, the support and journaling members comprising at least one journaling pin for each rolling body for defining said axis of rotation.

18. The shoe support device of claim 17, wherein the support and journaling members further comprise a link-arm system for supporting each rolling body via said at least one journaling pin.

19. The shoe support device of claim 18, wherein the link-arm system is pivotally connected to a fixed member of the first press element and is pivotally connected to the press shoe.

20. The shoe support device of claim 18, wherein the link-arm system comprises a link arm that supports the journaling pin via a resilient arrangement in said link arm to absorb stresses caused by rotary movements of the press shoe about a rotary axis that is perpendicular to a machine direction along which the web travels.

21. The shoe support device of claim 17, wherein the support and journaling members comprise a power cylinder system for supporting each rolling body via said at least one journaling pin.

22. A shoe press for a machine for manufacturing or treating a paper or cardboard web, the shoe press comprising:

first and second press elements arranged to form an extended nip therebetween in which the web is pressed, the first press element comprising a press shoe movable along a pressing direction toward and away from the second press element, an impermeable belt arranged to travel in an endless loop and make sliding contact with a pressing surface of the press shoe, a support stand for supporting the press shoe, and a power transmission member structured and arranged between the support stand and the press shoe to urge the press shoe in the pressing direction toward the second press element to press the web in the nip; and a shoe support device arranged to react lateral forces acting on the press shoe in a cross-machine direction during operation, the shoe support device comprising at least first and second pairs of support surfaces one of which support surfaces of each pair is fixed relative to the press shoe and the other of which support surfaces of each pair is fixed relative to the support stand, and which support surfaces extend in a machine direction and define a space therebetween, and at least one rolling body arranged in the space between each pair of support surfaces so as to roll along said support surfaces about a rotation axis that moves relative to and in the same direction as the press shoe.

23. The shoe press of claim 22, wherein the shoe support device further comprises support and journaling members for each said rolling body, the support and journaling members comprising at least one journaling pin for each rolling body for defining said axis of rotation.

24. The shoe press of claim 23, wherein the support and journaling members further comprise a link-arm system for supporting each rolling body via said at least one journaling pin.

25. The shoe press of claim 24, wherein the link-arm system is pivotally connected to a fixed member of the first press element and is pivotally connected to the press shoe.

26. The shoe press of claim 22, wherein the first and second pairs of support surfaces are formed by first and second support elements spaced apart along the cross-machine direction and a third support element arranged between and spaced from the first and second support elements, the first pair of support surfaces being formed by the first support element and one side of the third support element, the second pair of support surfaces being formed by the second support element and an opposite side of the third support element, the first and second support elements being affixed to one of the press shoe and the support stand and the third support element being affixed to the other of the press shoe and the support stand.

27. A shoe support device for a shoe press of a machine for manufacturing or treating a paper or cardboard web, wherein the shoe press includes first and second press elements arranged to form an extended nip therebetween in which the web is pressed, the first press element comprising a press shoe movable along a pressing direction toward and away from the second press element, an impermeable belt arranged to travel in an endless loop and make sliding contact with a pressing surface of the press shoe, a support stand for supporting the press shoe, and a power transmission member structured and arranged to urge the press shoe in the pressing direction toward the second press element to press the web in the nip, the shoe support device reacting forces that act on the press shoe in a cross-machine direction and comprising:

at least first and second pairs of support surfaces, one of the support surfaces of each pair being fixed relative to the press shoe and the other of the support surfaces of each pair being fixed relative to the support stand, support surfaces of each pair extending in a machine direction and defining a space therebetween, and at least one rolling body arranged in the space between each pair of support surfaces so as to roll along said support surfaces about a rotation axis that moves relative to and in the same direction as the press shoe.

28. The shoe support device of claim 27, further comprising support and journaling members for each said rolling body, the support and journaling members comprising at least one journaling pin for each rolling body for defining said axis of rotation.

29. The shoe support device of claim 28, wherein the support and journaling members further comprise a link-arm system for supporting each rolling body via said at least one journaling pin.

30. The shoe support device of claim 29, wherein the link-arm system is pivotally connected to a fixed member of the first press element and is pivotally connected to the press shoe.

31. The shoe support device of claim 27, wherein the first and second pairs of support surfaces are formed by first and second support elements spaced apart along the cross-machine direction and a third support element arranged between and spaced from the first and second support elements, the first pair of support surfaces being formed by the first support element and one side of the third support element, the second pair of support surfaces being formed by the second support element and an opposite side of the third support element, the first and second support elements being affixed to one of the press shoe and the support stand and the third support element being affixed to the other of the press shoe and the support stand.

* * * * *